US008326183B2

(12) United States Patent
Petermann

(10) Patent No.: US 8,326,183 B2
(45) Date of Patent: Dec. 4, 2012

(54) METHOD FOR DRYING PRINTED MATERIAL

(75) Inventor: Rudolf Petermann, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1007 days.

(21) Appl. No.: 12/329,923

(22) Filed: Dec. 8, 2008

(65) Prior Publication Data

US 2009/0148620 A1 Jun. 11, 2009

(30) Foreign Application Priority Data

Dec. 7, 2007 (DE) ..... 10 2007 058 957

(51) Int. Cl.
*G03G 15/11* (2006.01)
*G03G 15/20* (2006.01)

(52) U.S. Cl. ..... 399/251; 399/336

(58) Field of Classification Search ..... 399/251, 399/336, 337, 341; 101/416.1, 424.1, 424.2
See application file for complete search history.

(56) References Cited

U.S. PATENT DOCUMENTS

| | | | | |
|---|---|---|---|---|
| 4,989,343 | A | 2/1991 | Ericsson | |
| 5,115,741 | A | 5/1992 | Rodi | |
| 5,436,710 | A * | 7/1995 | Uchiyama | 399/336 |
| 6,562,413 | B1 | 5/2003 | Morgavi | |
| 6,857,368 | B2 | 2/2005 | Pitz | |
| 7,433,627 | B2 | 10/2008 | German et al. | |
| 2004/0206260 | A1 * | 10/2004 | Pitz et al. | 101/424.1 |
| 2005/0235851 | A1 | 10/2005 | Beier et al. | |
| 2006/0115306 | A1 * | 6/2006 | Lofthus et al. | 399/341 |

FOREIGN PATENT DOCUMENTS

| | | | |
|---|---|---|---|
| DE | 39 01 165 | A1 | 8/1990 |
| DE | 20201859 | U1 | 8/2002 |
| DE | 102 34 076 | A1 | 4/2003 |
| DE | 10 2004 015 700 | A1 | 11/2005 |
| DE | 10 2004 020 454 | A1 | 11/2005 |
| EP | 0349507 | A1 | 1/1990 |

(Continued)

OTHER PUBLICATIONS

European Search Report dated Jun. 4, 2009.

(Continued)

*Primary Examiner* — Walter L Lindsay, Jr.
*Assistant Examiner* — Rodney Bonnette
(74) *Attorney, Agent, or Firm* — Laurence A. Greenberg; Werner H. Stemer; Ralph E. Locher

(57) ABSTRACT

A method for drying printed material operates with the aid of a one-dimensional or two-dimensional array of radiation sources which can be driven individually or in groups. At the same time, the high-resolution image data describing the printing image or a content of printing forms for individual color separations is transformed into image data of lower resolution. Position data which describes the position of the printed image in the transport direction is also obtained from a device for transporting the printing material. Control data for modulation of an intensity of the radiation sources or groups of radiation sources of the array are generated from the image data of lower resolution and the position data, so that the printing material is swept over in the transport direction with time-modulated radiation points which in each case include a plurality of image points of the higher-resolution printed image.

24 Claims, 7 Drawing Sheets

FOREIGN PATENT DOCUMENTS

| | | | |
|---|---|---|---|
| EP | 0 355 473 | A2 | 2/1990 |
| EP | 0978388 | A2 | 2/2000 |
| EP | 0 993 378 | B1 | 4/2000 |
| EP | 1739504 | A2 | 1/2007 |
| EP | 1849603 | A1 | 10/2007 |
| FR | 2764844 | A1 | 12/1998 |

OTHER PUBLICATIONS

German Patent and Trademark Office Search Report, dated May 15, 2008.

* cited by examiner

METHOD FOR DRYING PRINTED MATERIAL

CROSS-REFERENCE TO RELATED APPLICATION

This application claims the priority, under 35 U.S.C. §119, of German Patent Application DE 10 2007 058 957.5, filed Dec. 7, 2007; the prior application is herewith incorporated by reference in its entirety.

BACKGROUND OF THE INVENTION

Field of the Invention

The invention relates to a method for drying printed material, for example printed paper sheets, paper or material webs or plastic films, labels, etc.

In particular, during multicolor printing, it is difficult to dry the printing material quickly and effectively before it is either printed with the next color or finished through the use of an application of varnish or turned in the printing press for the purpose of printing the reverse side. That is because, due to the relatively short time in which the printing material dwells between the printing units, it is not simple to arrange for the necessary radiated power to act on the printing material without damaging the printed image, for example by overheating.

It has already been proposed to reduce the dryer power in such a way that only the parts of the printing material that are actually covered with ink are irradiated. For example, in European Patent EP 0 355 473 B1, corresponding to U.S. Pat. Nos. 4,991,506 and 5,115,741, a description is given of using an array of UV waveguides for drying so-called UV ink, in which the intensity of the UV radiation emerging from the individual fibers is controlled by a sensor which detects the ink coverage of the image being swept over.

German Published, Non-Prosecuted Patent Application DE 102 34 076 A1, corresponding to U.S. Pat. No. 6,857,368, explains that printing inks provided with IR absorbers can be dried with the aid of a two-dimensional array of IR laser diodes and, in the process, the image content can be taken into account, without it being explained in detail how that is to be done.

It is known from European Patent EP 0 993 378 B1, corresponding to U.S. Pat. No. 6,562,413, in the case of inkjet printing, to dry printed dots by sweeping over the surface of the printing material with laser radiation with the aid of a mirror wheel scanner, with the intention being for the radiation to reach only the points of the printing material that are covered with ink. In that case, too, there is no more specific explanation as to how that is to be done in detail.

Furthermore, German Published, Non-Prosecuted Patent Application DE 10 2004 015 700 A1 discloses using one-dimensional or multi-dimensional arrays of UV laser diodes in order to dry sheets printed with UV ink. There, however, it is not drying as a function of the image content which is desired but the most uniform possible illumination of the printing material with UV radiation.

SUMMARY OF THE INVENTION

It is accordingly an object of the invention to provide a method for drying printed material, which overcomes the hereinafore-mentioned disadvantages of the heretofore-known methods of this general type and with which printing materials can be dried quickly and effectively.

With the foregoing and other objects in view there is provided, in accordance with the invention, a method for drying printed material. The method comprises driving a one-dimensional or two-dimensional array of radiation sources individually or in groups for drying the printed material. High-resolution image data, describing a printing image or a content of printing forms for individual color separations, is transformed into image data of lower resolution. Position data describing a position of the printed image in a transport direction is obtained from a device for transporting the printing material. Control data for modulation of an intensity of the radiation sources or groups of radiation sources of the array is generated from the image data of lower resolution and position data. Printing material is swept over in a transport direction with time-modulated radiation points each including a plurality of image points of a higher-resolution printed image.

The printing substrate, that is to say the material, for example a paper sheet or a material web, is dried with the aid of a one-dimensional or two-dimensional array of radiation sources. In this case, image data of low resolution already generated in the prepress stage, such as is used for example for presetting the ink key openings in offset presses, is also used to dry the printing material as a function of the image content. Accordingly, no sensors are required in order to first detect the ink coverage in the printed image. Furthermore, the expenditure on open-loop and closed-loop control which is needed in order to control the light sources or groups of light sources in the dryer in accordance with the ink content is within an acceptable order of magnitude, since image data with a reduced resolution is used and it is not necessary for each printed dot or each pixel of the rastered bit map to be addressed individually. The same applies to the optical outlay which is necessary to focus the radiation sources onto the surface of the printing material.

The image data of low resolution does not necessarily have to correspond to the grid spacing of the radiation sources of the array. This is because, expediently, the "coarse" image data picked up in the prepress stage is first converted into data with a further reduced resolution in a second step, with the resolution then being reduced further corresponding to the grid spacing of the radiation sources. The advantage of this two-stage method resides in the fact that data supplied from the prepress stage can be used in a standard way for quite different setting or operating procedures in the printing press, that is to say many times. The radiation sources of the array can, for instance, be the end face of waveguides or semiconductor radiators such as light-emitting or laser diodes. The wavelength of the radiation needed for the drying process is chosen as a function of the type of ink being used: for example UV radiation for reactively curing inks, visible light which is matched to the absorption by the pigments of the printed ink for offset inks, or infrared radiation in the case of inks with which IR absorbers are admixed.

Other features which are considered as characteristic for the invention are set forth in the appended claims.

Although the invention is illustrated and described herein as embodied in a method for drying printed material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
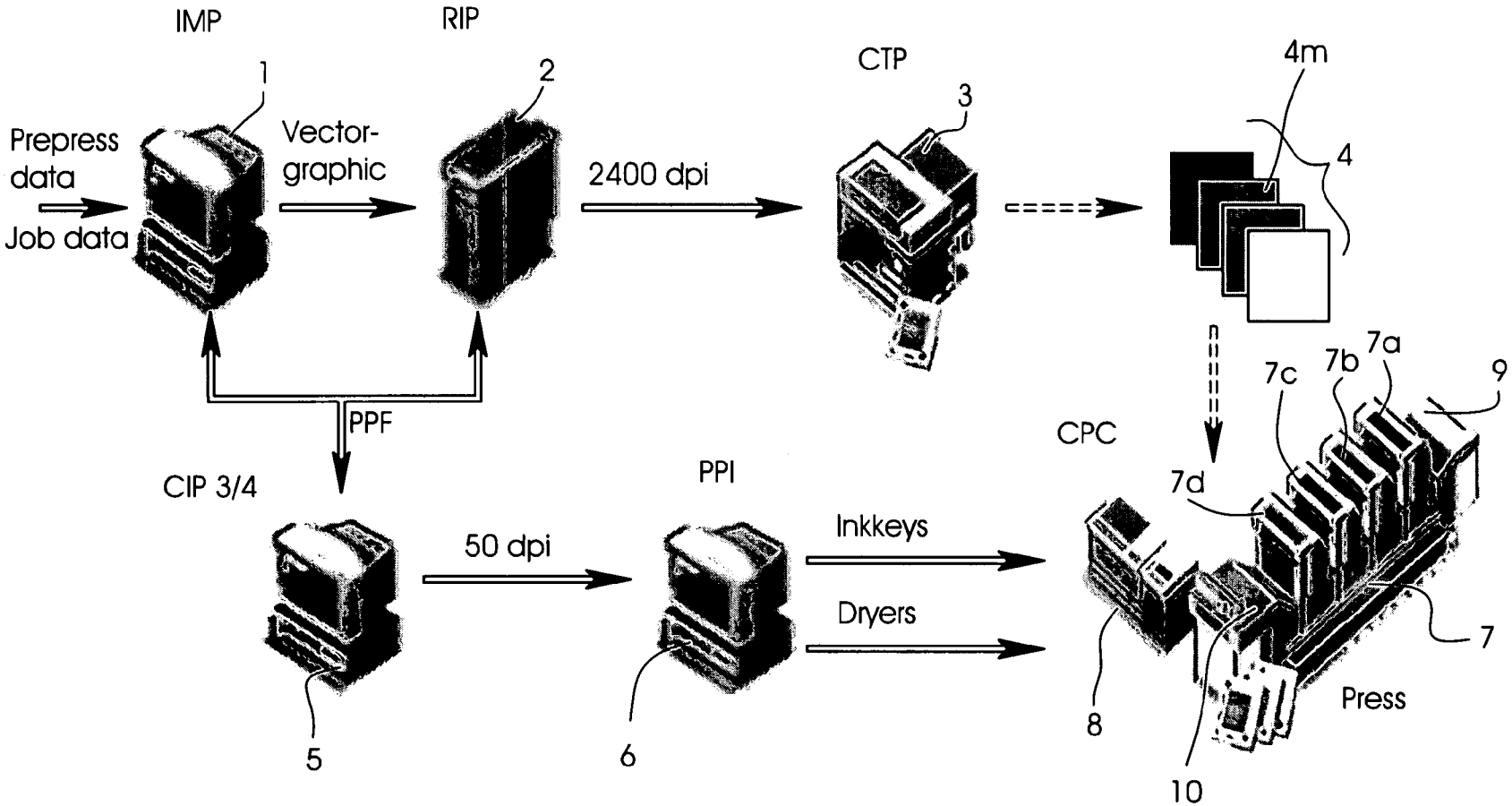
FIG. 1 is a simplified basic flow chart which is used to explain the data flow from a prepress stage to a printing press illustrated in perspective views, with reference to the method of the invention.

Referring now to the figures of the drawings in detail and first, particularly, to FIG. 1 thereof, there is seen a workstation 1 on which an image to be printed is imposed, by carrying out so-called impositioning. At this point, the data from the printed page is present as a vector graphic, which can be output, for example as a proof on a printer, with a resolution of typically 600 dpi. It is possible for the pixels of the image on the proofer to typically have a color depth of 16 bits. This data is used, amongst other things, as a basis for setting up four printing plates in the colors black, cyan, magenta and yellow, which are designated by reference numeral 4 in FIG. 1. The data is screened into the four color separations, specifically in a so-called raster image processor 2 for the exposure of these printing plates. The resolution of the raster pixels in the screened color separation, which is typically 2400 dpi, is therefore very much finer since each image point is broken down in accordance with the color depth into a different number of raster pixels. The raster image data is transferred to a plate exposer 3, which is a so-called "computer to plate" device, in which the four printing plates are exposed one after another in the aforementioned primary colors.

Figure 2:
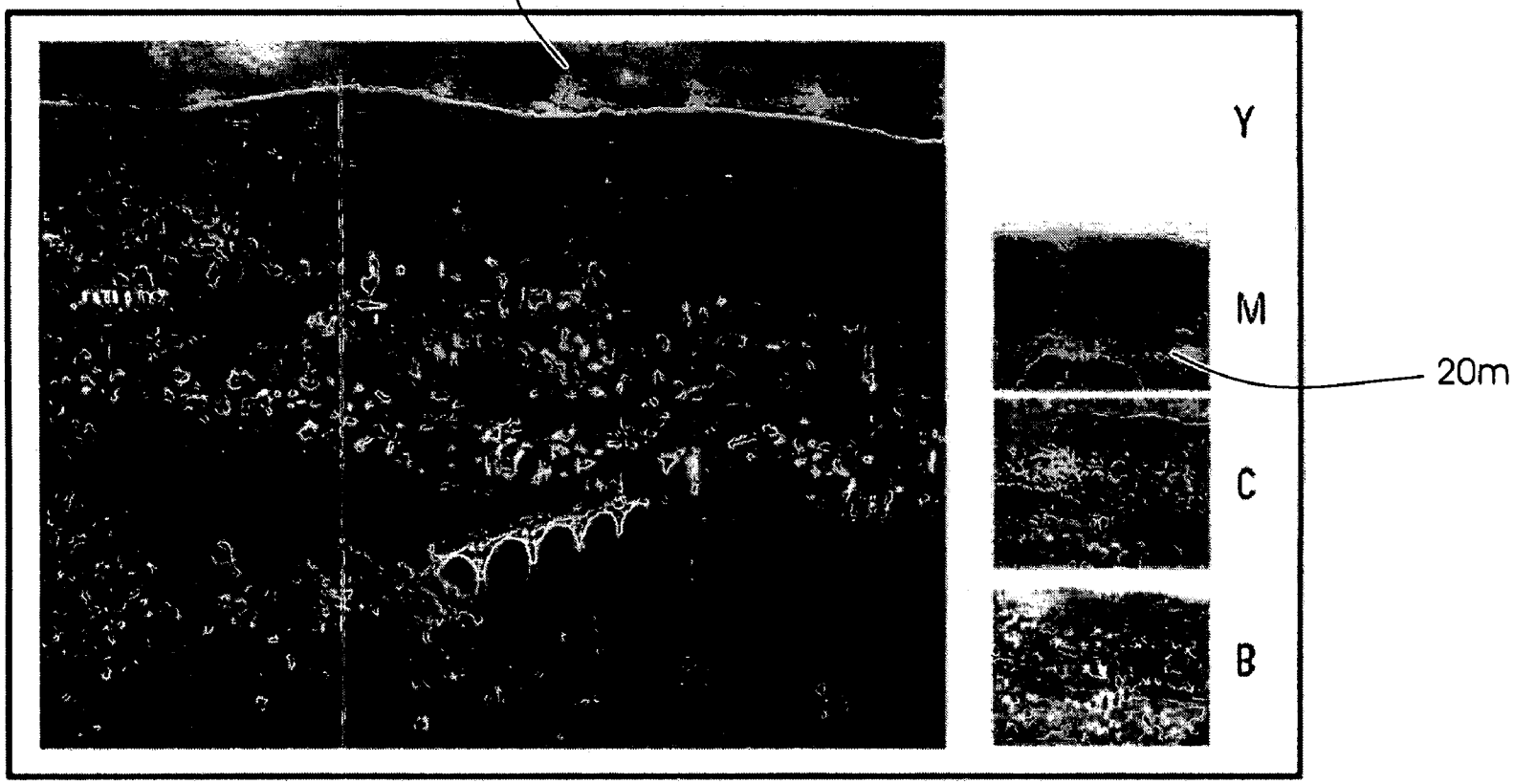
FIG. 2 shows a colored image and color separations illustrating regions to be exposed which are different for four printing plates.

The size and position of the regions to be exposed is different for the four printing plates, as is illustrated in the example according to FIG. 2.

FIG. 2 shows a colored image 20 of a well-known German university city on the left-hand side and, beside it on the right, illustrated in a reduced size, the color separations yellow (Y), magenta (M), cyan (C) and black (B). The regions to be inked on the corresponding printing plate are illustrated as dark, while the ink-free regions are illustrated as light.

The prepress stage likewise includes a workstation 5 shown in FIG. 1, on which the imposed colored image, the color separations and the screened color separations can be produced, processed, stored and displayed. In this case, it is emphasized that the data on this workstation 5 is present in a so-called PPF format (print production format), which has been generated specifically for the data interchange between the various devices which are used during the production of printed products. According to the standard on which this format is based in accordance with CIP3/CIP4, the production of a so-called "rough image" (preview image) from the data of the imposed printing image is also provided. This preview image typically has a very much coarser resolution of 50 dpi and is also available in the four color separations.

The CIP3/CIP4 specification recommends the use of the data from these rough images for presetting ink key openings, of which each of four printing units 7*a* to 7*d* of a printing press 7 or an inking unit 16*a* to 16*d* contained therein (see FIG. 5) has typically between 16 and 32 items, depending on the format width of the printing press. This is typically done by the various printing press manufacturers, in a so-called prepress interface (PPI) 6. This is a personal computer or industrial PC which adds up the proportions of the ink coverage from the data from the preview images within the individual ink keys and converts them into a setting value for motors in the individual inking units, by which the key openings are actuated. These setting values are transferred to a machine control system 8, where they are converted into control signals for motor controllers.

According to one exemplary embodiment of the present invention, the data of the coarsely resolved preview images is also used for the purpose of drying the sheets printed in the printing press 7 or, in the case of a web-fed printing press, the printed web as a function of the image, that is to say substantially to apply radiation to the points at which printing ink is actually also located.

Figure 5:
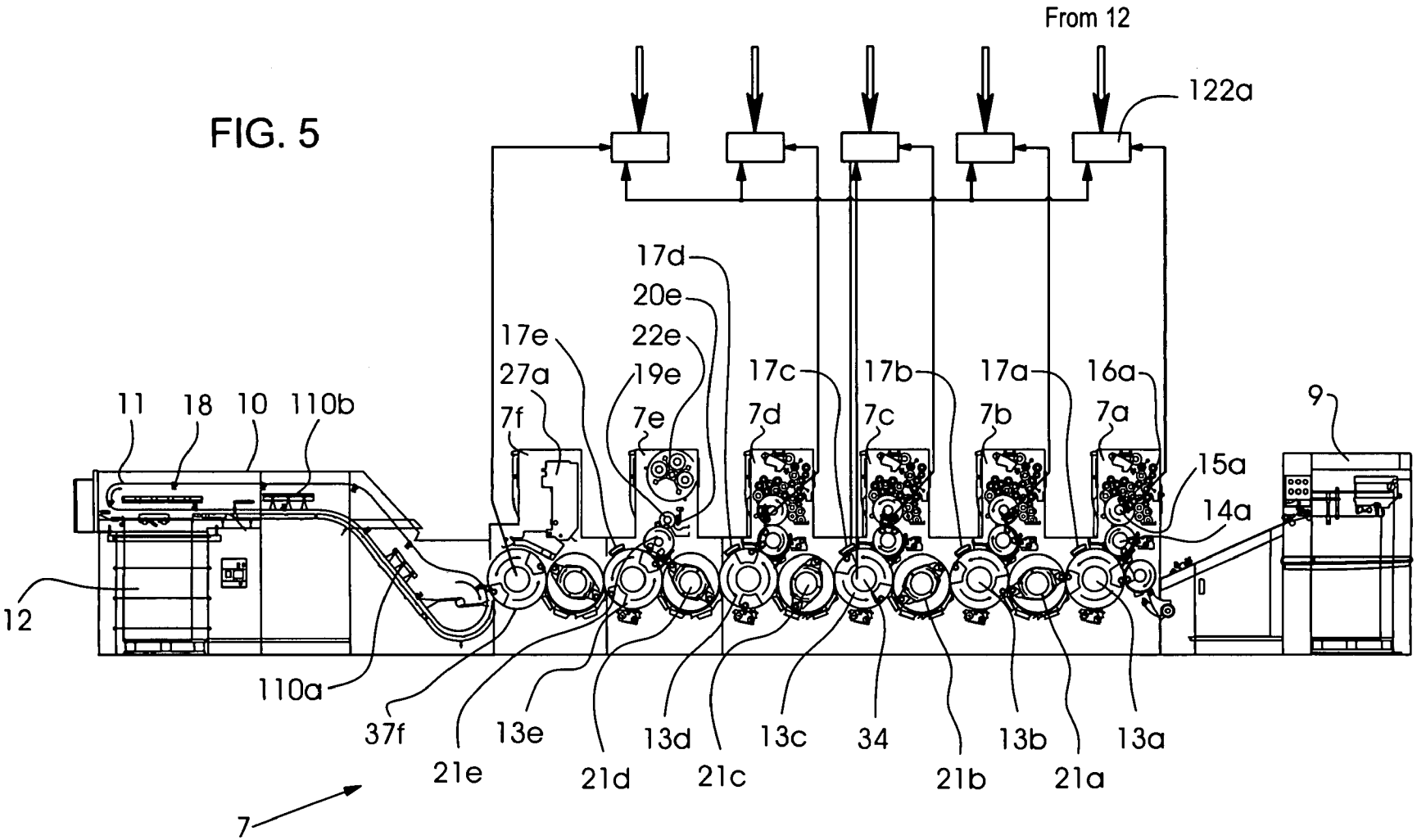
FIG. 5 is a longitudinal-sectional view of a typical four-color sheet-fed printing press.

Before this is explained in more detail, we refer to the basic sketch illustrated in FIG. 5 of a typical four-color sheet-fed printing press with a downstream varnishing unit. FIG. 5 shows an offset printing press 7 of inline construction having a feeder 9, in which an unprinted paper stack is located, and four printing units 7*a* to 7*d* for the four primary colors. Each printing unit has an impression cylinder 13*a*, a blanket cylinder 14*a*, a plate cylinder 15*a* and an inking unit 16*a*. These subassemblies are only provided with designations for the first printing unit 7*a*. Transferors 21*a* to 21*d* between the printing units transport the printed sheets from one printing unit to the next. The fourth printing unit 7*d* is followed by a varnishing unit 7*e* of the "chamber doctor" type, that is to say it has an engraved-cell roll 19*e* and a chamber-type doctor 20*e*. Reference symbol 22*e* designates a so-called "engraved roll star", which contains three further engraved rolls with different cell size, against which the engraved roll 19*e* can be exchanged, in order to determine the quantity of varnish to be applied in this way. In the varnishing unit 7*e* the printed sheet is covered completely with varnish by a varnish applicator cylinder 21*e* or printed with spot varnish, depending on the type of varnishing plate being used (rubber blanket or flexible form).

The varnishing unit 7*e* is followed by a drying tower 7*f*. In this drying tower, the sheet which is transported through is dried in the region of the cylinder 37*f* by hot air and infrared radiation if, for example, aqueous emulsified varnish is applied to the printed sheets in the varnishing unit 7*e*.

The dryer 7*f* is followed by a delivery 10 of the printing press. In the latter, gripper bars 18 circulate through the use of a chain guide 11. These gripper bars 18 pick up the varnished sheets and guide them through under the withdrawable or plug-in dryer units 110*a* to 110*b*, where the sheets are once more dried with infrared radiation and/or hot air and, in the process, the applied varnish is solidified. The sheets, which are dried in this way, are subsequently deposited on a sheet stack 12 in the delivery 10.

In the exemplary embodiment described, the printing press 7 is intended to print with so-called UV inks, i.e. inks which do not dry by oxidation under the action of heat or infrared radiation and by absorption into the paper, as is usual in offset printing, but are cured by the irradiation with ultraviolet light. Such inks and offset presses which are specifically equipped for printing with UV inks are known per se. In order to dry the inks, a so-called intermediate deck dryer 17*a* to 17*d*, which provides the necessary UV radiation, is disposed in the sheet transport path over the impression cylinders 13*a* to 13*d* in each case. There is also such an intermediate deck dryer 17*e* above the impression cylinder 13*e* of the varnishing unit 7*e*. By using this intermediate deck dryer 17*e*, for example UV spot varnish can be dried, specifically in the same way as in the intermediate deck dryers 17*a* to 17*d*, as a function of the printed image, that is to say in this case as a function of the varnish image.

For the case in which water-based varnish is printed in the varnishing unit 7*e* and, for example is also applied over the whole area of the printed image, the drying tower 7*f* disposed after the varnishing unit 7*e* can also be activated. The drying tower 7*f* contains a hot-air dryer 27*a*, with which water vapor is driven out of the water-based varnish.

The additional dryer units 110*a* and 110*b* can be provided in the region of the chain guide of the delivery 10 for the purpose of further drying of the printed and varnished sheets, as is known per se and generally usual. These can, for example, be infrared dryers or UV dryers, depending on the type of inks and varnishes being printed, in order to dry them still further before the deposition on the delivery stack 12. These dryers 110*a* and 110*b* are typically constructed as withdrawable or plug-in units, so that different dryer types can be inserted as required at this point.

Figure 6B:
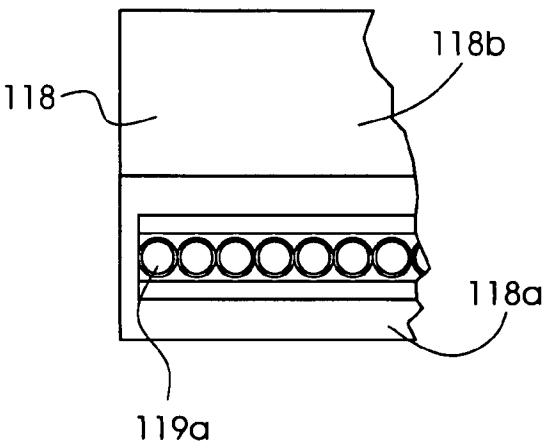
FIGS. 6A, 6B and 6C are fragmentary views showing the construction of intermediate deck dryers.
Figure 6C:
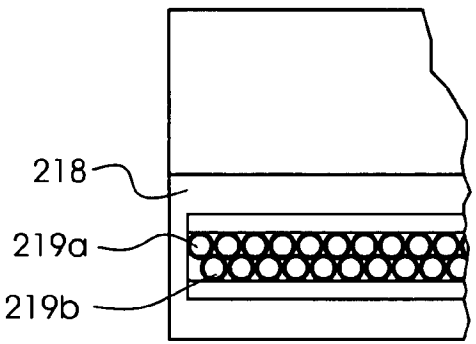
Figure 6A:
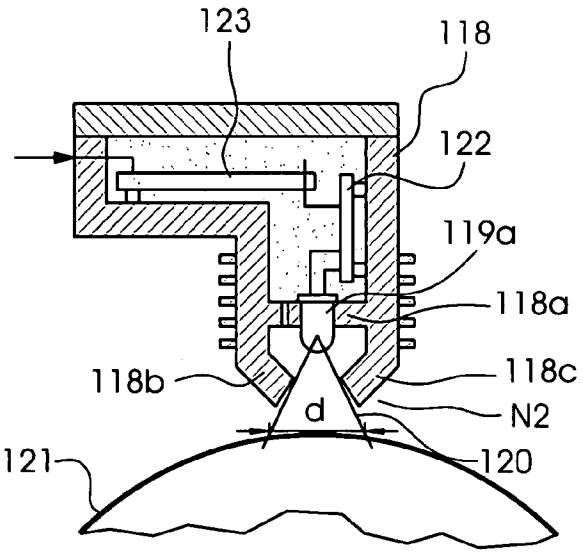

The intermediate deck dryers 17*a* to 17*e* of this exemplary embodiment of the invention are constructed as described by using FIGS. 6A to 6C. They each contain one or more arrays 119 of UV radiators, in each case in a housing 118 that is closed and flushed with inert gas, for example $N_2$. These UV radiators are light-emitting diodes 119*a* to 119*n*, which emit ultraviolet radiation in a wavelength range of 370 to 385 nanometers, as is needed for the activation of photoinitiators with the aid of which the UV inks polymerize. These photoinitiators, such as Lucirin® TPO, which is offered by BASF AG in Ludwigshafen, Germany, have an absorption maximum in a wavelength range around 380 nanometers.

UV diodes in this spectral range are currently offered with outputs in a range between several microwatts and several watts and, for example, can be procured through the Roithner Lasertechnik company in Vienna, Austria. UV diodes have typical housing dimensions of 3 or 5 millimeters in diameter, if they are individual diodes, and can be procured with different beam divergences 120. By using such diodes, it is possible to build up linear arrays from individually addressable UV light sources which, without specific front-end optics, with a working distance of several centimeters, generate spots of light of d=about 3 to 10 millimeters in diameter on a printed sheet 121, so that the sheet 121 running through under such an array can be irradiated with coverage from side to side.

Electronics 123 for driving the light-emitting diodes 119*a* to 119*n* are accommodated in the housing 118, as is a control computer 122 assigned to each intermediate deck dryer and illustrated schematically as a block diagram in FIG. 5 for better clarity, the function of which will be described later. The housing 118 is produced from solid aluminum, ribbed in the region of the LED array 119 in order to ensure good cooling of the LEDs 119*a* to 119*n* of the array. The LEDs 119*a* to 119*n* are inserted in thermal contact into holes in an intermediate plate 118*a*. The LEDs 119*a* to 119*n* are protected against soiling by strips 118*b* and 118*c* projecting on both sides, with the inert gas $N_2$ flowing out of a slot between the strips preventing the penetration of ink mist or moisture into the space in front of the end of the LEDs 119*a* to 119*n*. As an alternative to this, a radiation window that is removable, for example, and protects the ends of the LEDs 119*a* to 119*n* against soiling, can be fitted between the strips 118*b* and 118*c*.

It is also possible for a plurality of rows of LEDs 219*a* to 219*n* to be disposed in an intermediate deck dryer 218. If a plurality of rows of LEDs, for example 50 rows, are disposed one after another in the transport direction of the printed sheet in such a way that corresponding LEDs lie on a line, the same image points of the printed image can be irradiated repeatedly one after another, in order to increase the output of the dryer. Furthermore, the intensity of the illumination on the sheet to be dried can be evened out through suitably selected coverage of the cones of radiation.

Figure 3:
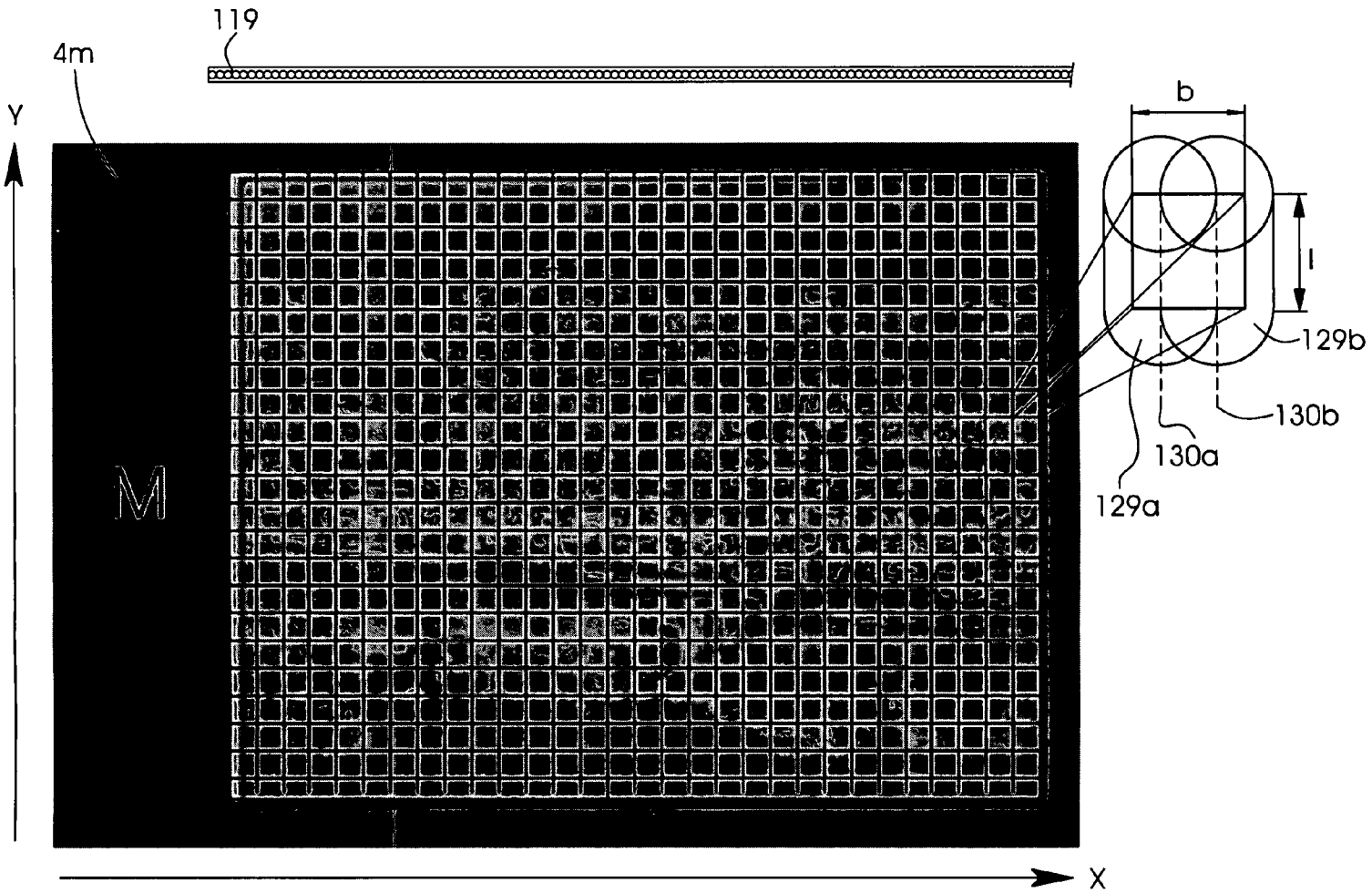
FIG. 3 shows a simplified linear array of a UV diode configuration, a rough preview image of a magenta color separation and an auxiliary grid.

The latter is illustrated more clearly once more by using FIG. 3, in the upper region of which the linear array 119 of the UV diode configuration can be seen in simplified form in a view of the end face. The rough preview image of the magenta color separation is shown below the upper region. A rectangular auxiliary grid, which is used only for explanation, is placed over this color separation. Each square cell of this auxiliary grid has a dimension of b=10 millimeters. A spacing a at which the diodes 119*a* of the LED array 119 are disposed is 5 millimeters, that is to say that when the LEDs are switched on each cell of the auxiliary grid is swept over by two UV light bars 129*a* and 129*b* which overlap partly, so as to compensate for a drop in the intensity from mid-axes 130*a*, 130*b* toward edges of the bands of light of the UV light bars 129*a*, 129*b*.

Further evening out can be achieved if, as illustrated in FIG. 6C, a further array of UV LEDs 219 is provided, which is offset in relation to the first array 119 by half the grid spacing of a/2=2.5 millimeters. Then, each cell of the auxiliary grid is assigned four LEDs and, with appropriate driving of adjacent LEDs, it is possible to achieve a higher output density and more uniform distribution of the UV radiation on the sheet to be dried.

The length of each light bar which is needed to sweep over the auxiliary cell is given by the machine speed, that is to say the speed with which the printed sheet 121 moves past under the intermediate deck dryer 117 or under the UV LED array 119, and the turn-on time of the relevant LEDs. At full machine speed, the sheet moves at about 5 meters/second so that, given a turn-on time of 2 milliseconds, the result is a length of the light bars 129*a* and 129*b* of 10 millimeters. If use is made of LEDs which emit a light output of 500 mW, in each cell of the auxiliary grid, as the sheet passes, UV radiation with an energy of 2 diodes×two milliseconds×0.5 watt=2 milliwatt seconds is input, which corresponds to a dose rate of 2 $mJ/cm^2$. This dose rate is already sufficient for the drying of UV inks. A higher radiation dose rate can be achieved by the configuration of a plurality of LED arrays one after another in the sheet transport direction.

Figure 7:
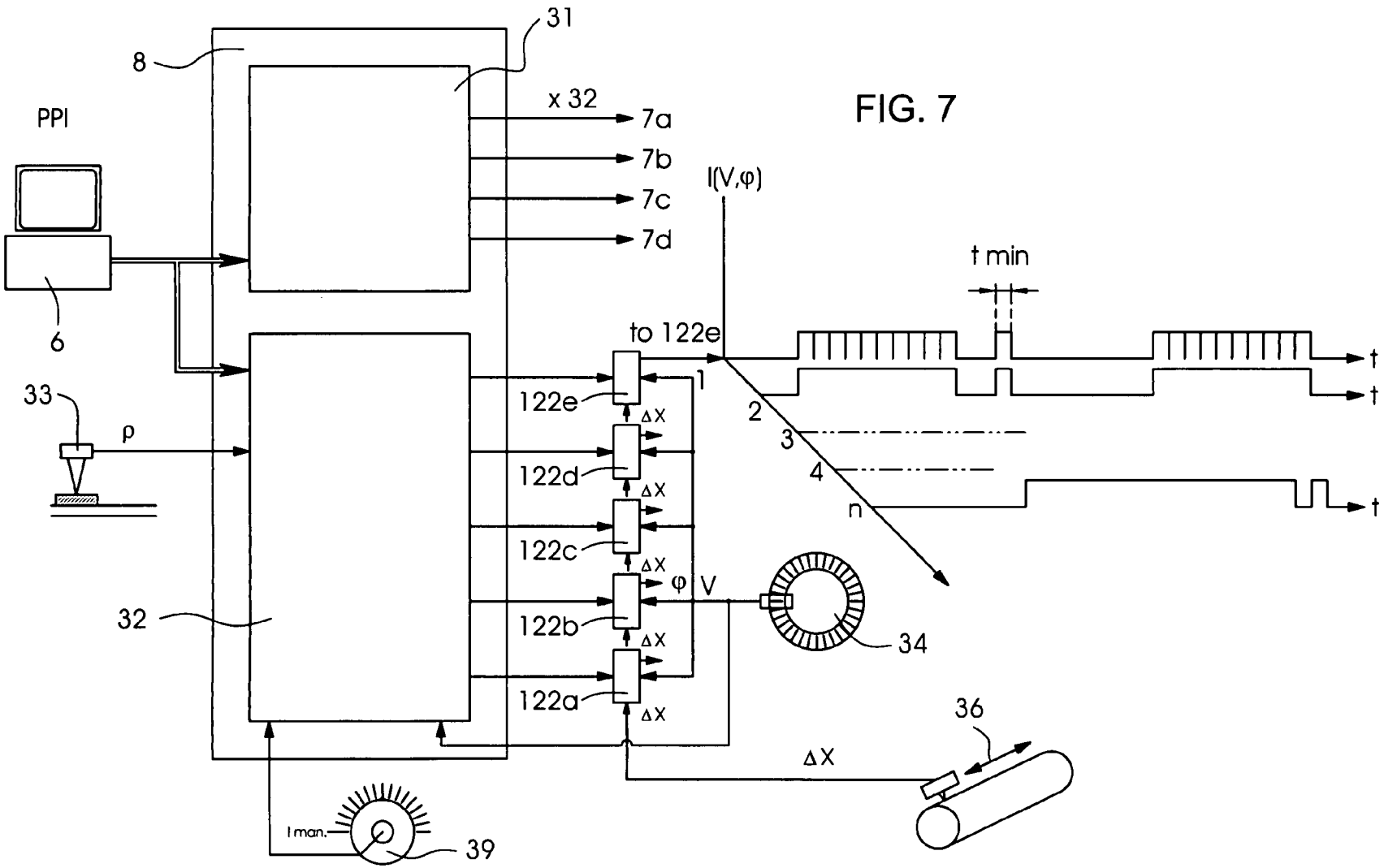
FIG. 7 is a block diagram showing important electronic components for controlling LED arrays in the intermediate deck dryers and exemplary signal waveforms.

What is important for the function of the present invention is the synchronization between the movement of the printed sheet through under the intermediate deck dryers 17*a* to 17*d* with the turn-on and turn-off times of the UV LEDs of the array 119 and also the correct assignment of the diodes to the printing image in the axial direction as referred to the cylinders of the printing press. This will be explained in detail below by using FIG. 7. FIG. 7 is a block diagram which shows the important electronic components for controlling the LED arrays 119 in the intermediate deck dryers 17*a* to 17*e* as well as exemplary signal waveforms for driving the individual LEDs in the array of an intermediate deck dryer.

As already mentioned at the beginning during the description of FIG. 1, the machine control system 8 is connected through a data line to a so-called prepress interface (PPI) 6 of a commercially available personal computer or industrial PC having appropriate image evaluation software and, in order to preset the ink key openings in the inking units of the printing press, obtains from there the values determined in the PPI 6 for the ink key openings. The motor controller, to which these values are transferred, is designated by reference numeral 31. It supplies the control signals for each of the 32 ink key motors, for example, with which each inking unit 16*a* to 16*d* in the four printing units 7*a* to 7*d* is equipped. After or possibly even before these values have been transferred, the data which describes the turning on and turning off of the LEDs 119*a* to 119*n* of the arrays in the intermediate deck dryers 17*a* to 17*e* is transferred from the PPI 6 to a module 32 of the machine control system 8 that is assigned to the intermediate deck dryers. This data is based on the respective coordinate system of the four printing plates 4 which have been exposed or are to be exposed together with the prepress data in the CTP device 3 in accordance with the screening of the images by the RIP 2 (see FIG. 1).

In the control module 32, this data is prepared specifically for the machine and then transferred to the dryer controllers 122*a* to 122*e* in the intermediate deck dryers 17*a* to 17*e*. This includes, firstly, the determination of the starting time, that is to say the time at which the first sheet, for example, runs into the printing unit 7*c* and the drying in the associated intermediate deck dryer 17*c* begins. This value is calculated from an angular value $\phi$ which is supplied by an encoder 34 (see FIG. 5) to the cylinder 13*c*, on which the main drive of the printing press acts. The relative positions of the printing units and transport path differences of the sheets between the individual printing units 7*a* to 7*d* connected to one another by gear wheels are stored in the module 32, as is the physical association between the positions of the individual intermediate deck dryers 17*a* to 17*e* and the machine angle.

As an alternative to the computational assignment of the start of the printing image through the machine constants, it is of course likewise possible instead to provide a sensor in each printing unit, through which the start of the printed image on the sheet conveyed through under the respective intermediate deck dryer or the edge of the sheet is detected.

The drying of the printed sheets additionally depends on the layer thickness of the ink with which they are printed. This can be determined, for example, with appropriate measuring instruments by using a sample print. Accordingly, the control module 32 in the machine control system 8 is connected to a photometer 33, through which an ink layer thickness $\rho$ is measured. The corresponding values are used to preset the intensity of the LEDs 119*a* to 119*n* in the arrays 119 and/or 219. Furthermore, a possible manual correction is provided for setting the intensity of the LEDs. This can be any desired input tool, for example a potentiometer 39 or else an input, for example through a touchscreen, on a non-illustrated monitor belonging to the machine control system 8.

In addition, it can be expedient to check the LEDs 119*a* to 119*n* with regard to the radiation output emitted thereby. This can be done, for example, by an array of photo receivers, which continuously monitors the radiation output in the region of the LED array 119, or by a calibration operation provided regularly, for example before each print job.

Then, as in the simplified illustrated diagram, the signal waveforms calculated in the PPI 6 for the respective printing plates of the individual LEDs of the arrays 119 and/or 219 are transferred to the dryer controllers 122*a* to 122*e* of the intermediate deck dryers 17*a* to 17*e*, following appropriate modification by the module 32 of the machine control system 8. However, the variation of these signals over time depends on the machine speed v. The same is true of the intensity. This is because, when the machine is running slowly, the printed sheet is located for a longer time in the range of action of the radiation of the individual LEDs of the intermediate deck dryers, so that the intensity of the UV light-emitting diodes can be reduced or the LEDs can be operated in pulsed fashion with longer pause times between the pulses.

Within the drying cycle for a sheet, the turn-on and turn-off times for the individual LEDs are likewise controlled through the machine angle supplied by the encoder 34. To this end, the dryer controllers 122*a* to 122*e* are likewise connected to the encoder 34 and in this way are synchronized directly with the machine angle $\phi$ without the diversion through the control module 32 in the machine control system 8. This ensures that, even when starting up and running down the machine, the drying of the printed image is carried out with exact register, based on the circumferential register of the impression cylinders.

Furthermore, an automatic offset printing press normally also has an automatic register control system, which acts on the axial position of the printing plate cylinders and accordingly is able to displace the printing image laterally, as well as a diagonal register adjustment. In order to rule out or to compensate for the influence of the register control system 36 on the drying as a function of the printed image, which is important in particular when the image-dependent drying is carried out at high resolution, signals $\Delta x$ from a register control system 36 can likewise be transferred directly to the dryer controllers 122*a* to 122*e*. If then, for example, the register control system displaces the plate cylinder axially by 5 millimeters and the grid spacing of the LEDs is 2.5 millimeters, the stored signal waveforms in the dryer controllers 122*a* to 122*e* are displaced "by two LED positions", that is to say re-assigned, for example by the seventh LED being driven with the signal waveform of the fifth LED and so on.

The preparation of the control data for the individual LEDs in the intermediate deck dryers 17*a* to 17*e* in the PPI 6 takes place as follows: normalized signal waveforms are generated over the length of the printing plate from the preview images for the individual color separations, resolved at 50 dpi, for each UV light-emitting diode, for example 119*a* to 119*n*. For this purpose, in a manner similar to that illustrated in FIG. 3, the printing plate is provided with an auxiliary grid, the grid elements of which for example include one or more, for example two, LEDs in the axial direction. In the circumferential direction referred to the cylinder over which the printing plate is moved, the resolution or the length of the elements of the auxiliary grid does not necessarily have to be the same as in the transverse direction but, since this resolution is determined by the turn-on time of the LEDs, can also be chosen to be coarser, for example. However, a finer resolution in the transport direction is expedient only when front-end optics are used, since the areas of illumination generated by each LED are generally circular or elliptical. However, by using front-end optics in the form of a cylindrical lens which extends over the entire length of the LED array, for example, a linear focus can also be produced transversely with respect to the transport direction. In this case, the resolution in the transport direction can also be chosen to be lower than in the direction transverse thereto.

In the present case, the same resolution in both coordinate directions is assumed. Since the control signals for the LEDs are generated from the 50 dpi preview image, which corresponds to about 20 image pixels per centimeter, but the grid spacing of the LEDs is greater and, for example, is around 2.5 millimeters, a plurality of pixels, for example 50×50 image points of the preview image, are combined to form one cell and this cell is viewed as a unit.

Figure 4:
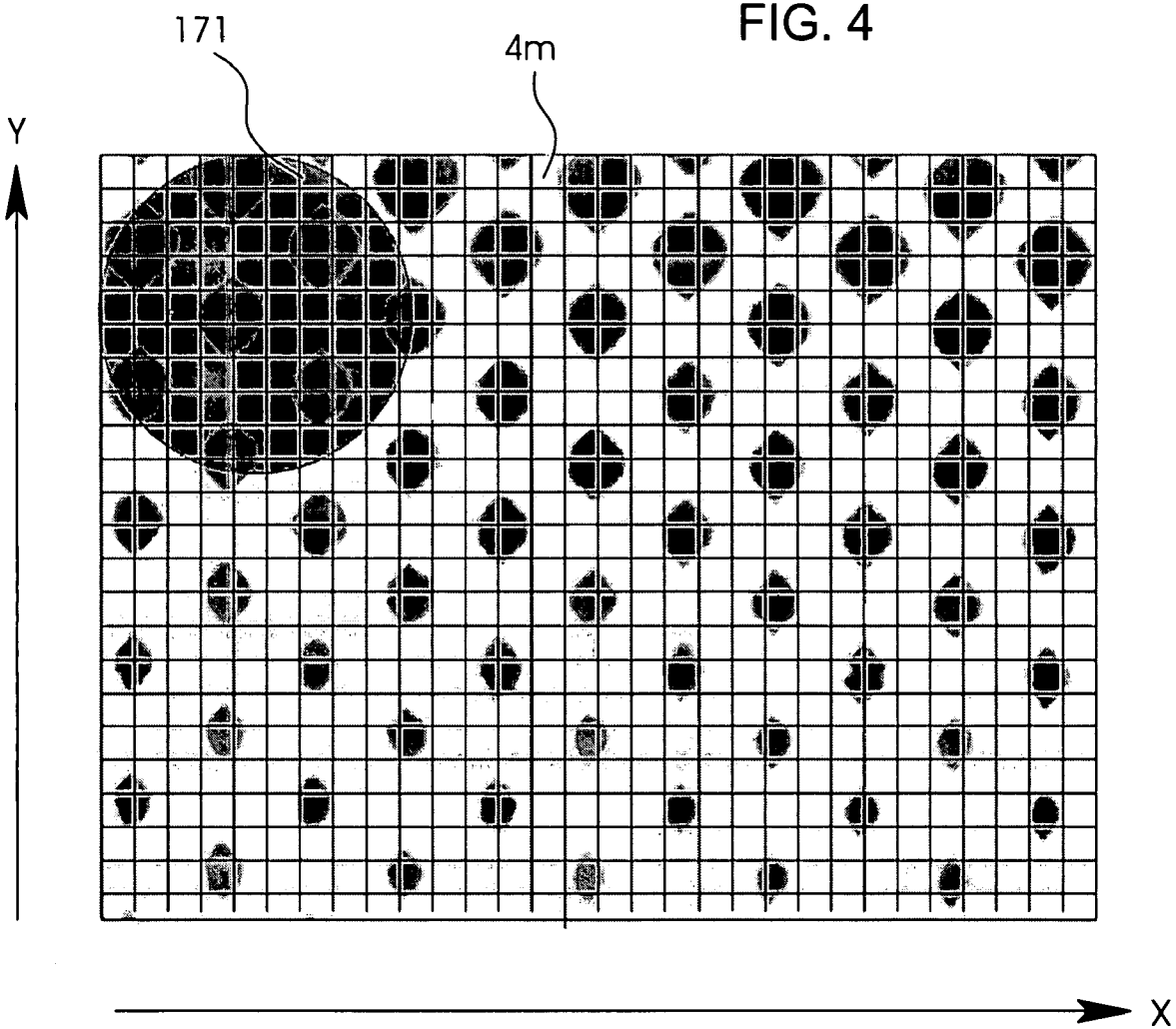
FIG. 4 shows a portion of a sheet that has been printed and is to be dried.

It is then determined in the PPI 6 whether, for the color separation considered, color components are contained at all in the respective cell of the auxiliary grid or whether raster points are or have been set there at all by the exposer 3. If this is not the case, then the relevant LED(s) remain(s) dark for the corresponding time or machine angle interval. In the other case, when at least one raster point is located in the region of a cell of the auxiliary grid, the corresponding LED is turned on for the relevant time interval or machine angle interval. As opposed to the ink key presetting, however, in the dryer controller it is not a matter of the quantity and size of the raster points exposed on the plate but whether or not a raster point has been placed on the printing plate in the respective cell of the auxiliary grid during the exposure or whether or not a corresponding ink dot has been printed on the printed sheet. This is because, since each ink dot needs UV radiation in order to be dried, the intensity of the LEDs can only be reduced if not only the size of the raster points but also their layer thickness decreases. This is generally not the case. This becomes clear by using the simplified illustration according to FIG. 4. There, a portion of a sheet 4*m* that has been printed and is to be dried with individual LEDs is illustrated in highly enlarged form. Spots 171 of the LEDs extend over very many columns of raster points, as can be seen from the figure. Although the ink coverage in the upper region of the illustration is very much greater than in the lower region, the intensity of the light-emitting diode which produces the spot 171 must be maintained in order to ensure that all of the raster points that are swept over are dried adequately.

A reduction in the intensity with which the LEDs radiate or in the pulse duration in the case of pulse-operated LEDs is possible, however, if the raster points become so small that the ink layer thickness of the raster points in the print decreases and, in addition, the influence of scattered radiation on the curing of the UV ink increases. The corresponding functional relationship can likewise be taken into account in the PPI 6 by an intensity variation I(y) calculated for the individual LEDs by the PPI 6 as a function of location in the transport direction y of the sheet, together with the image lightness at the relevant point being provided with correction values which were determined previously and stored in a table, for example, and which describe the functional relationship mentioned.

As already explained above, the radiation sources of adjacent LEDs overlap. In this case, it is necessary to take into account the fact that not only is the intensity in the edge regions of the irradiated field firstly lower than at its center but, secondly, the duration of the irradiation on the moving sheet is also shorter because of the shorter secant in the edge region of the illuminated spot 171. It is therefore indicated to choose the auxiliary grid in such a way that the cells of the auxiliary grid are smaller than the spot of light produced by the respective LED, in any case with regard to the dimensions at right angles to the direction of movement.

In the above description, the invention was described by using LED diodes which emit UV light in order to dry sheets printed with UV inks. However, it is also possible and within the scope of the invention, when printing is carried out with offset inks, to use light sources or LEDs which radiate in the visible wavelength range and are matched to the absorption behavior of the pigments of the printed ink. Likewise, it is possible to use arrays of radiation sources which emit infrared radiation if, for example, the wavelength of the infrared radiation is matched to absorber substances which are mixed with the printing ink.

Furthermore, the invention was described by using intermediate deck dryers which are assigned to each printing unit. However, it is likewise possible to provide a dryer following the four printing units, for example, in order to dry the ink printed on in its entirety. In this case, it is not necessary to process the data of the individual color separations individually. For instance, this can be the withdrawable or plug-in dryer units present in the delivery 10 which, in the case in which they are constructed as final UV dryers, are either provided with individually drivable UV sources in order to dry as a function of image content or else, if appropriate, over the entire area.

In a further exemplary embodiment, as an alternative to the method outlined, the procedure is as follows:

In a first step, the prepress interface PPI picks up the data of the already screened color image separation at the resolution of the rastered image of, for example, 2400 dpi from the RIP 2, if appropriate sequentially. The PPI then transforms this high-resolution image data directly into image data with the coarse resolution, which corresponds approximately to the grid spacing of the light-emitting diodes. In this case, the procedure is such that, for each cell of the corresponding coarse auxiliary grid it is determined whether there are raster points in the auxiliary cell and, if appropriate, how large these are in order that, by using the first exemplary embodiment described for the method, an adaptation of the intensity can be carried out. By using this information, the processor of the PPI then calculates the signal waveforms I(y) for the individual LEDs, stores them and transfers them to the machine control system 8, where the signal waveforms are transformed into those dependent on the machine angle $\phi$. The method then proceeds in such a way as described above by using the other exemplary embodiment.

The invention claimed is:

1. A method for drying printed material, the method comprising the following steps:

driving a one-dimensional or two-dimensional array of radiation sources individually or in groups for drying the printed material;

transforming high-resolution image data, describing a printing image or a content of printing forms for individual color separations, into image data of lower resolution in a first step;

converting the image data of lower resolution in a second step into data with a resolution reduced once more being matched to a grid of the radiation source array;

obtaining position data describing a position of the printed image in a transport direction from a device for transporting the printing material;

generating control data for modulation of an intensity of the radiation sources or groups of radiation sources of the array from the image data of lower resolution and position data; and sweeping over printing material in a transport direction with time-modulated radiation points each including a plurality of image points of a higher-resolution printed image.

2. The method according to claim 1, wherein the high-resolution image data is from screened color separations.

3. The method according to claim 2, wherein the radiation sources have a grid spacing lying in a range between 0.2 millimeters and 8 millimeters.

4. The method according to claim 2, wherein the radiation sources have a grid spacing lying in a range between 2 and 5 millimeters.

5. The method according to claim 1, which further comprises printing the printed image with ink curing under UV radiation, and forming the one-dimensional or two-dimensional radiation source array of end faces of UV waveguides or semiconductor light sources emitting UV radiation.

6. The method according to claim 1, which further comprises printing the printed image with ink curing under visible light, forming the one-dimensional or two-dimensional radiation source array of end faces of waveguides emitting visible light or semiconductor light sources emitting visible light, and matching a wavelength of the light to pigments of the printed ink.

7. The method according to claim 1, which further comprises printing the printed image with ink curing under infrared radiation, forming the one-dimensional or two-dimensional radiation source array of end faces of infrared waveguides or semiconductor light sources emitting infrared radiation, and matching a wavelength of the infrared radiation to IR absorbers present in the printing ink.

8. The method according to claim 1, wherein a resolution of control data for modulation of the intensity of the radiation sources is coarser in the transport direction of the printing material than transverse thereto.

9. The method according to claim 1, which further comprises providing a multi-dimensional array or a plurality of linear arrays of light sources disposed individually one after another, and driving light sources disposed one after another in the transport direction of the printing material in such a way that they each irradiate the same image points of the printed image.

10. The method according to claim 1, which further comprises controlling the intensity of the radiation from the light sources continuously or in steps.

11. The method according to claim 1, which further comprises drying the printed image in a printing press.

12. The method according to claim 11, which further comprises providing the printing press with a plurality of individual printing units for various colors and dryer devices each being disposed after or in a respective one of the individual printing units.

13. The method according to claim 12, which further comprises providing one or more further dryers being primarily used for integral drying of varnish layers placed over the printed image.

14. The method according to claim 1, which further comprises additionally feeding a controller of a dryer device with data being a measure of a layer thickness of the printed image or the printed color separations.

15. The method according to claim 1, which further comprises additionally feeding a controller with data describing a contrast or a local variation in a layer thickness of the printed ink.

16. The method according to claim 1, wherein the one-dimensional or two-dimensional array of radiation sources is encapsulated.

17. The method according to claim 16, which further comprises providing the encapsulation with a removable radiation window.

18. The method according to claim 16, which further comprises filling or flushing at least one of a space within the encapsulation or a space between the array and the printing material, with inert gas.

19. The method according to claim 1, wherein the radiation sources have a grid spacing lying in a range between 0.2 millimeters and 8 millimeters.

20. The method according to claim 1, wherein the radiation sources have a grid spacing lying in a range between 2 and 5 millimeters.

21. A method for drying printed material, the method comprising the following steps:

driving a one-dimensional or two-dimensional array of radiation sources individually or in groups for drying the printed material;

transforming high-resolution image data, describing a printing image or a content of printing forms for individual color separations, into image data of lower resolution;

obtaining position data describing a position of the printed image in a transport direction from a device for transporting the printing material, the resolution of the image data of the lower resolution color separation image being coarser in the transport direction of the printing material than transverse thereto;

generating control data for modulation of an intensity of the radiation sources or groups of radiation sources of the array from the image data of lower resolution and position data; and sweeping over printing material in a transport direction with time-modulated radiation points each including a plurality of image points of a higher-resolution printed image.

22. A method for drying printed material, the method comprising the following steps:

driving a one-dimensional or two-dimensional array of radiation sources individually or in groups for drying the printed material;

checking light sources of the array or groups of light sources with regard to radiation output thereby;

transforming high-resolution image data, describing a printing image or a content of printing forms for individual color separations, into image data of lower resolution;

obtaining position data describing a position of the printed image in a transport direction from a device for transporting the printing material;

generating control data for modulation of an intensity of the radiation sources or groups of radiation sources of the array from the image data of lower resolution and position data; and sweeping over printing material in a transport direction with time-modulated radiation points each including a plurality of image points of a higher-resolution printed image.

23. A method for drying printed material, the method comprising the following steps:

driving a one-dimensional or two-dimensional array of radiation sources individually or in groups for drying the printed material;

transforming high-resolution image data, describing a printing image or a content of printing forms for individual color separations, into image data of lower resolution, the resolution of the lower-resolution image data being between 5 and 100 dpi;

obtaining position data describing a position of the printed image in a transport direction from a device for transporting the printing material;

generating control data for modulation of an intensity of the radiation sources or groups of radiation sources of the array from the image data of lower resolution and position data; and sweeping over printing material in a transport direction with time-modulated radiation points each including a plurality of image points of a higher-resolution printed image.

24. A method for drying printed material, the method comprising the following steps:

driving a one-dimensional or two-dimensional array of radiation sources individually or in groups for drying the printed material;

transforming high-resolution image data, describing a printing image or a content of printing forms for individual color separations, into image data of lower resolution, the resolution of the lower-resolution image data being about 50 dpi;

obtaining position data describing a position of the printed image in a transport direction from a device for transporting the printing material;

generating control data for modulation of an intensity of the radiation sources or groups of radiation sources of the array from the image data of lower resolution and position data; and sweeping over printing material in a transport direction with time-modulated radiation points each including a plurality of image points of a higher-resolution printed image.

* * * * *